United States Patent [19]

Chen et al.

[11] Patent Number: 4,912,929

[45] Date of Patent: Apr. 3, 1990

[54] VARIABLE GAS SPRING FOR MATCHING POWER OUTPUT FROM FPSE TO LOAD OF REFRIGERANT COMPRESSOR

[75] Inventors: Gong Chen; William T. Beale, both of Athens, Ohio

[73] Assignee: Sunpower, Inc., Athens, Ohio

[21] Appl. No.: 389,162

[22] Filed: Aug. 3, 1989

[51] Int. Cl.[4] ..... F02G 1/06

[52] U.S. Cl. ..... 60/520; 62/6

[58] Field of Search ..... 60/520; 62/6

[56] References Cited

U.S. PATENT DOCUMENTS

| | | | |
|---|---|---|---|
| 3,487,635 | 1/1970 | Prast et al. | 60/520 |
| 4,458,495 | 7/1984 | Beale | 60/520 |
| 4,811,563 | 3/1989 | Furuishi et al. | 60/520 X |

*Primary Examiner*—Allen M. Ostrager
*Attorney, Agent, or Firm*—Frank H. Foster

[57] ABSTRACT

The power output of a free piston Stirling engine is matched to a gas compressor which it drives and its stroke amplitude is made relatively constant as a function of power by connecting a gas spring to the drive linkage from the engine to the compressor. The gas spring is connected to the compressor through a passageway in which a valve is interposed. The valve is linked to the drive linkage so it is opened when the stroke amplitude exceeds a selected limit. This allows compressed gas to enter the spring, increase its spring constant, thus opposing stroke increase and reducing the phase lead of the displacer ahead of the piston to reduce power output and match it to a reduced load power demand.

8 Claims, 3 Drawing Sheets

VARIABLE GAS SPRING FOR MATCHING POWER OUTPUT FROM FPSE TO LOAD OF REFRIGERANT COMPRESSOR

This invention was made as a result of work under Contract No. DE-AC05-840R21400 between the U.S. Department of Energy and Martin Marietta Energy Systems, Inc., Subcontract No. 86X-SA578V to Sunpower, Incorporated. The Government has certain rights in this invention.

TECHNICAL FIELD

This invention relates generally to free piston Stirling engines and more particularly relates to an apparatus for matching the power delivered by a free piston Stirling engine to the load power demanded by a refrigerant compressor in a resonant free-piston system in a heat pump over a wide range of operating conditions.

BACKGROUND ART

A very highly efficient heat pump or refrigeration unit can be constructed by connecting a free piston Stirling engine to a compressor and driving the unit with thermal input energy, such as from gas fuel. Such an apparatus includes multiple reciprocating masses, interconnected together and to ground by means of effective springs and operates typically in resonance. An inherent operating characteristic of the simple free piston Stirling engine is that its output stroke amplitude increases as the power delivered by the engine increases when other operating parameters don't vary. Therefore, in the absence of compensating structure, as the load upon the engine is reduced, its stroke will ordinarily increase and can increase sufficiently that damage to the mechanical components can result. This problem is particularly difficult when a free piston Stirling engine is used to drive the compressor of a refrigeration unit. The power demand of such a load will vary as the result of variations in the ambient temperature or other conditions effecting heat transfer into the cooled chamber or from the heat exchanger and condenser or as a result of normal cycling of the refrigeration unit as it maintains the cooled chamber between upper and lower temperature limits. Because of the relatively slow reaction time of the heated masses within the free piston Stirling engine, the thermal response time is relatively slow so that it becomes impractical to reduce the heat energy input as a means for reducing the power output of the free piston Stirling engine.

Therefore, it is desirable to provide a compensating apparatus which will quickly reduce the engine output power when a reduced load is encountered and quickly increase the output power when an increased power is demanded by the load. Ideally the compensating apparatus would continuously match the engine output power to the load power demand throughout a wide operating range and maintain engine reciprocation amplitude relatively constant so that critical clearances can be maintained.

BRIEF DESCRIPTION OF INVENTION

These and other objects and features of the invention may be accomplished by connecting a gas spring to the drive linkage that links the free piston Stirling engine to the compressor so that the gas spring applies a spring force parallel to the axis of the drive linkage reciprocation. An inlet gas passage is connected in communication between the high pressure portion of the refrigeration apparatus and the gas spring for at times supplying refrigerant into the gas spring. A valve means is interposed in the inlet gas passageway and is linked to the drive linkage for opening the valve to permit refrigerant to flow into the gas spring and thereby increase the pressure and, as a result, increase the spring constant of that gas spring when the drive linkage amplitude of reciprocation exceeds a selected limit. This increase of gas spring pressure and resulting increase in the system operating frequency and the spring constant, decreases the phase lead of the displacer ahead of the piston in the free piston Stirling engine to reduce the engine power output of the free piston Stirling engine.

Figure 1:
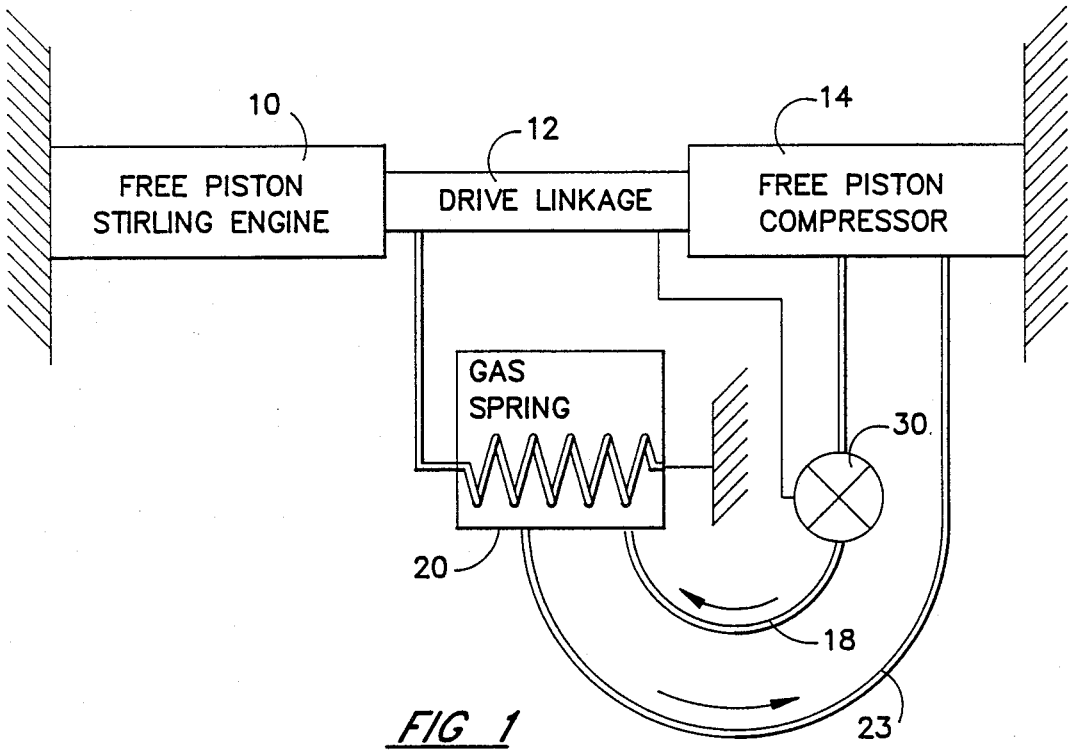
FIG. 1 is a simple diagrammatic view of an embodiment of the invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other circuit elements where such connection is recognized as being equivalent by those skilled in the art.

DETAILED DESCRIPTION

Figure 2:
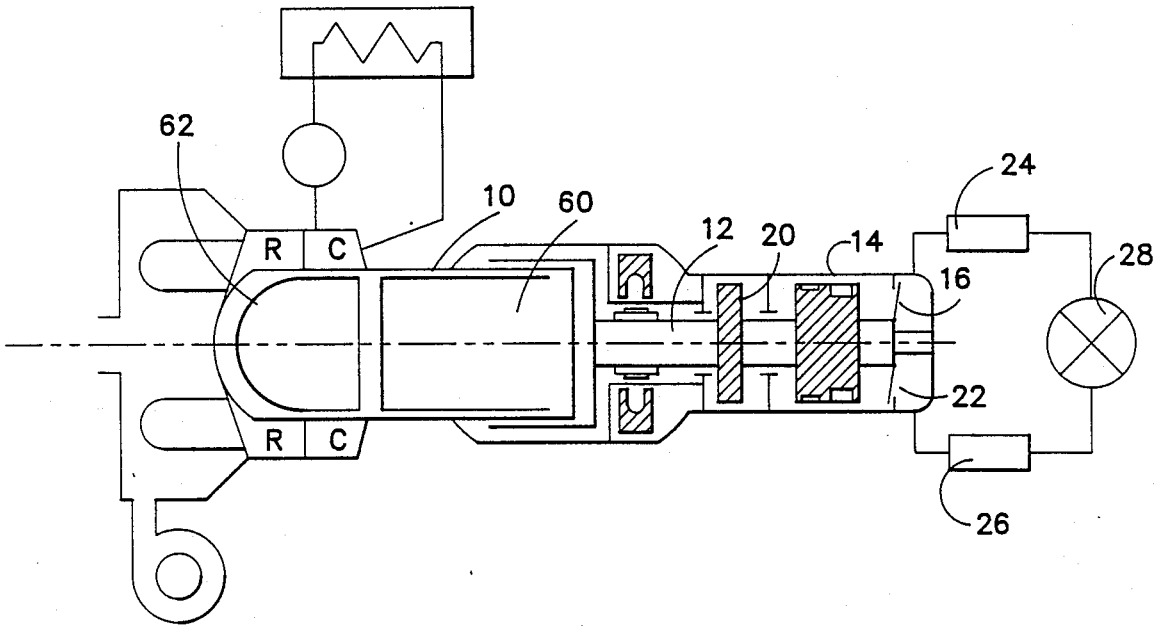
FIG. 2 is a diagrammatic view of a preferred embodiment of the invention.

FIGS. 1 and 2 diagrammatically illustrate the invention. A free piston Stirling engine 10 is connected through a drive linkage 12, such as a piston rod, to a compressor 14. The compressor 14 has a high pressure portion 16 connected by a passageway 18 to a gas spring 20 embodying the present invention. It also has a low pressure portion 22 connected through a conduit 23 to the gas spring 20. The compressor 14 is a part of a refrigeration apparatus which includes a conventional condenser 24 and evaporator 26, along with a refrigerant expansion valve 28. The compressor 14 operates in the conventional manner to compress gas from the low pressure portion 22 and discharge it into the high pressure portion 16 for recirculation within the refrigeration apparatus.

The gas spring 20 is mechanically connected to the drive linkage so it applies a spring force to the drive linkage, parallel to the axis of the drive linkage reciprocation.

A valve 30 is interposed in the inlet gas passageway which is connected in communication between the high pressure portion of the refrigeration apparatus and the gas spring for at times supplying refrigerant into the gas spring. The valve 30 is connected by a drive linkage which opens the valve to permit refrigerants to flow into the gas spring and increase the pressure in the gas spring when the drive linkage amplitude of reciprocation exceeds a selected, design limit.

Figure 3:
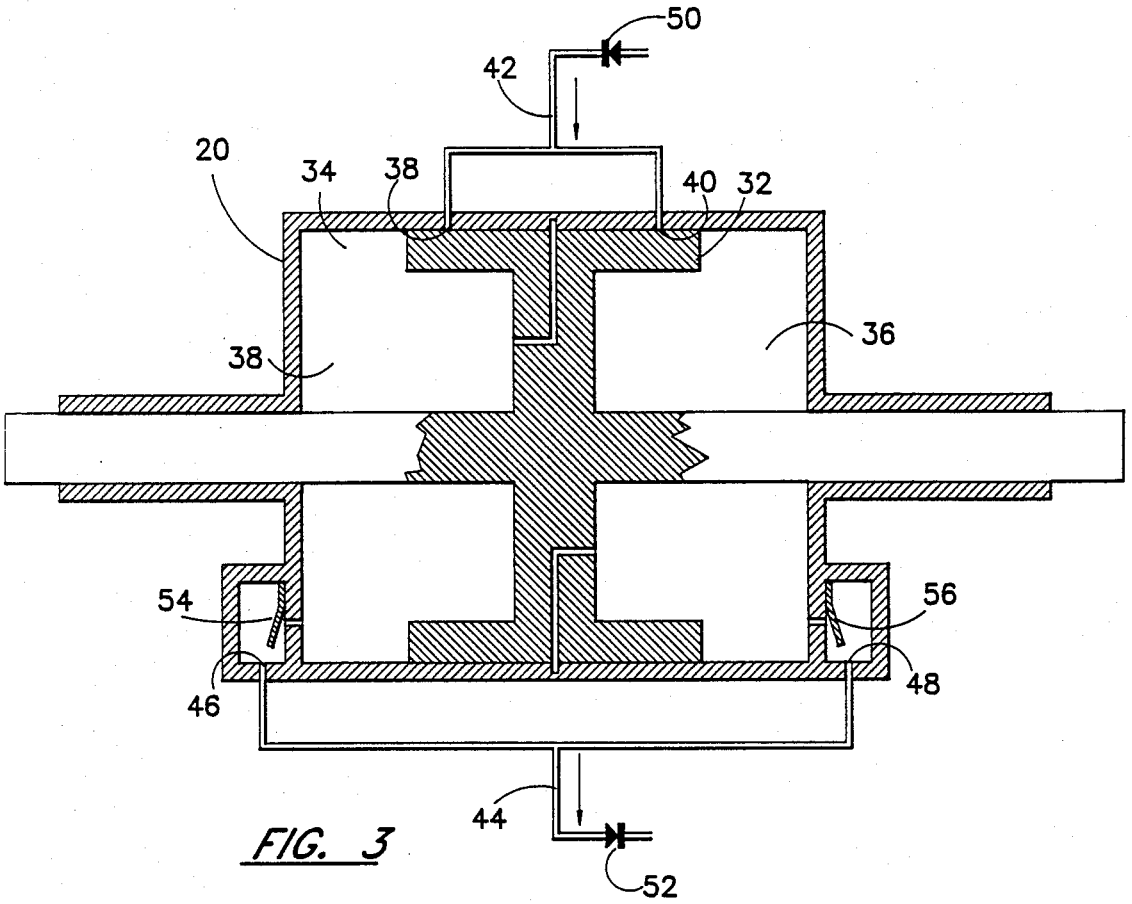
FIGS. 3 and 4 are detailed views of a gas spring embodying the present invention, illustrated in two different positions.
Figure 4:
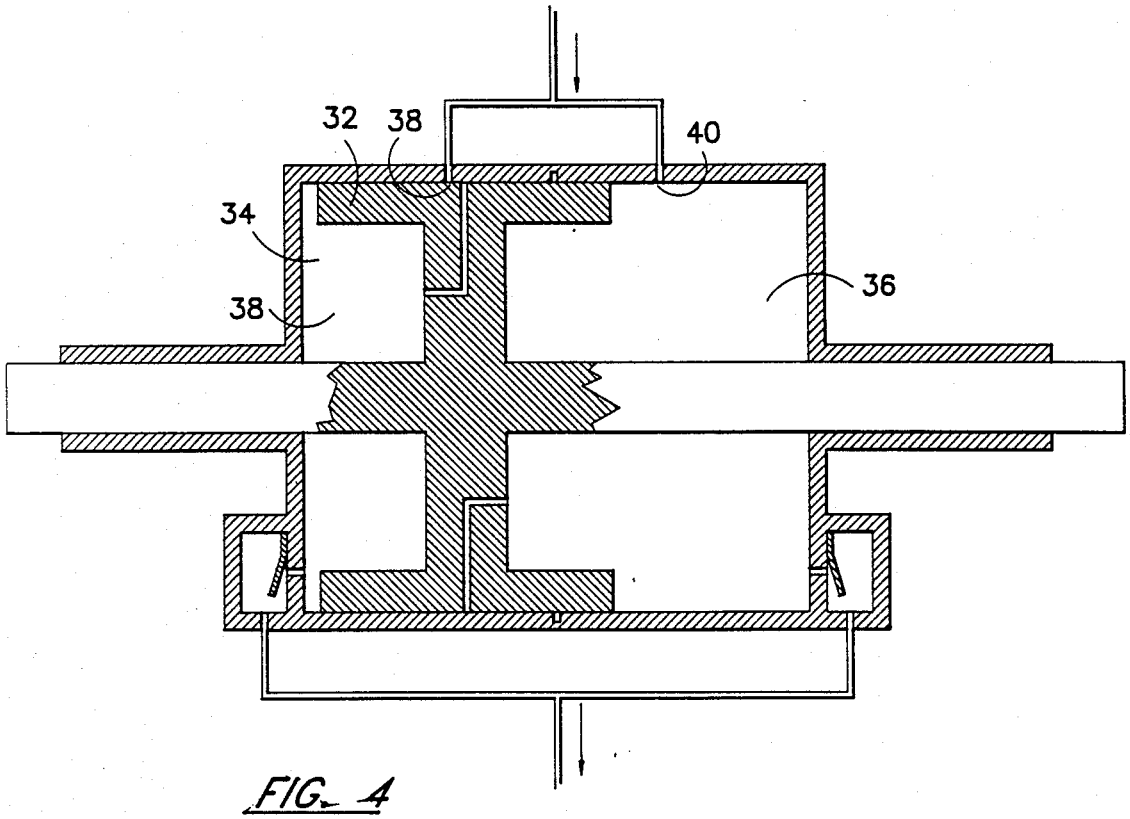

Referring to FIGS. 3 and 4, the gas spring preferably comprises a piston 32 which is sealingly slidable within a cylinder 34. Although the invention is not limited to a double acting spring, the preferred spring illustrated is double acting having annular spring spaces 36 and 38. A pair of inlet ports 39 and 40 in the wall of the cylinder 34 are offset from the center of reciprocation of the piston 32 so that the piston-cylinder combination can operate as a spool valve. The ports 39 and 40 are positioned so that they are blocked by the piston 32 when the reciprocation amplitude is less than the selected limit. Under this blocked condition, gas cannot pass through the inlet gas passageway 42 into the gas spring. However, the ports 39 and 40 are positioned so that they are exposed and thus the ports are opened to permit refrigerant to enter the gas spring spaces 36 and 38 when the reciprocation amplitude exceeds the selected limit. The position of the piston 32 at such an amplitude of reciprocation is illustrated in FIG. 4 in which the inlet port 40 is exposed to permit gas to enter the spring space 36. During the opposite excursion of the piston 32, the inlet port 38 will be similarly exposed.

Desirably, a refrigerant return flow gas passageway 44 is connected between the gas spring spaces 36 and 38 and the low pressure portion of the refrigeration apparatus for returning refrigerant to the refrigeration apparatus. A restricted orifice, such as orifices 46 and 48, are interposed in the return flow gas passageways for limiting the return gas flow rate. This permits gas to be injected into the gas spring spaces 36 and 38 when the reciprocation amplitude exceeds the selected limit, but permits that gas to relatively, slowly trickle from that space. As a result, if power demand by the compressor increases and therefore amplitude of reciprocation decreases, the gas spring can return to the lower gas pressure which permits a higher power output from the engine. Ordinarily, a equilibrium condition is reached for each power level since the quantity of gas permitted to be injected into the gas spring increases as stroke increases because the ports 38 and 40 are exposed for a longer time interval and vice versa.

Preferably, check valves 50, 54, and 56 are interposed in both of the gas passageways at a polarity to assure that refrigerant gas can flow only from the high pressure portion to the low pressure portion of the refrigeration apparatus. This arrangement is also able to make the range of the gas spring pressure adjustable to lower than low refrigerant pressure or higher than high refrigerant pressure.

In operation, the free piston Stirling engine/ compressor combination operates as a resonant oscillating unit. The operating frequency is a function of many parameters including the compression load and the masses and the spring constants to which the masses are connected. Since the gas spring 20 of the present invention is a spring effectively connected to the power piston 60, its spring constant will effect the frequency of operation and therefore also the phase of the piston 60, relative to the phase of the displacer 62. This will result in a relative advance of the phase angle of the piston relative to the displacer, thus reducing the phase lead of the displacer ahead of the piston. As is known to those skilled in the art, a reduction in the displacer lead will reduce the power output of the free piston Stirling engine. The opposite occurs for a decrease in the gas pressure of the gas spring.

Therefore, as the drivingly linked power piston and compressor piston move into an overstroke, the path to the high pressure flow is opened and gas will flow into the spring space. This, in turn, will oppose the stroke increase as the spring constant increases and will decrease the phase lead of the displacer, thereby reducing the power. Opposite result will occur when the ports 39 and 40 are closed so that gas cannot enter from the high pressure portion of the compressor and gas leaks out of the gas spring 20 to reduce its gas pressure.

Therefore, the operation of the gas spring provides compensation for overstroke, permitting the engine power output to be automatically adjusted to match the load power demand.

By properly applying known engineering technique in selecting the mass of the spring 20, its volume and the gas flow rates, the power piston stroke can be maintained in an equilibrium which approximates a constant amplitude reciprocation.

Figure 6:
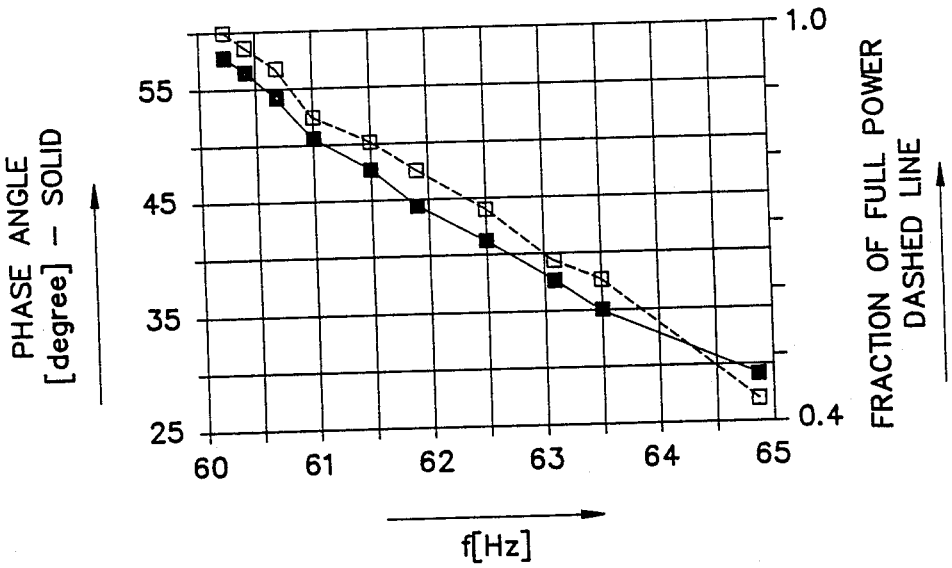
FIG. 6 is a graph illustrating the operation of an embodiment of the invention.

FIG. 6 illustrates a typical operating characteristic in which the phase angle decreases and the engine power simultaneously decreases as the operating frequency slightly increases.

Figure 5:
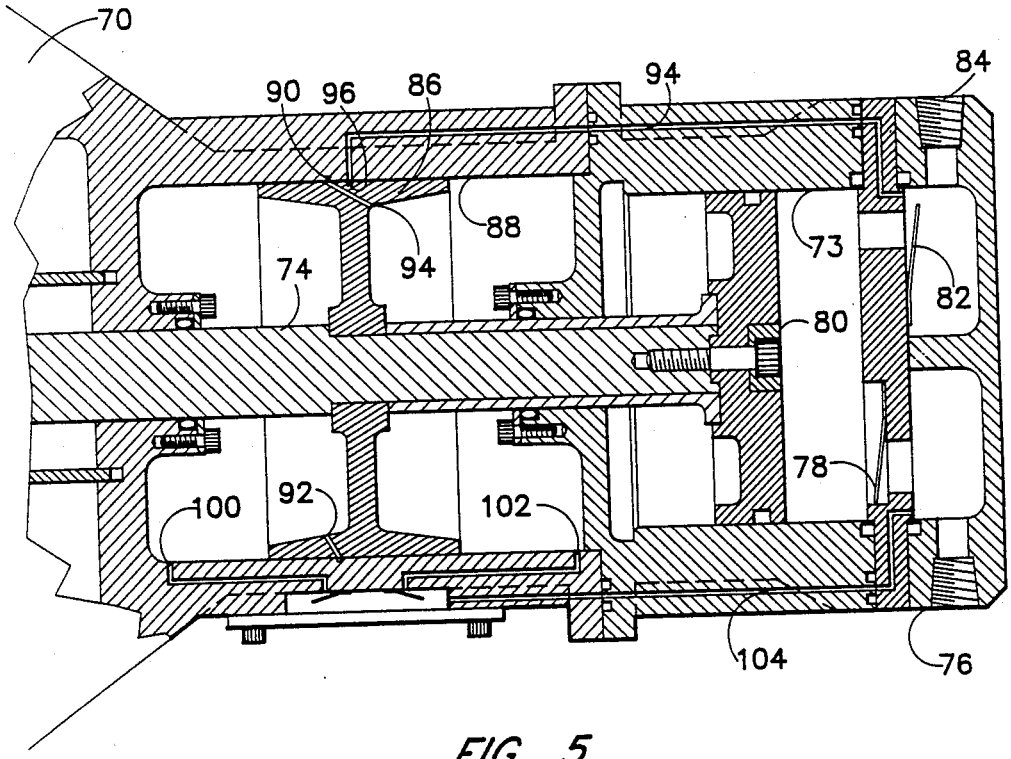
FIG. 5 is a view in axial section of a portion of a free piston Stirling engine, a gas spring embodying the present invention, and a compressor unit in accordance with the present invention.

FIG. 5 illustrates a preferred embodiment of the invention. The free piston Stirling engine 70 of FIG. 5 is not illustrated because it may be of conventional design and the invention does not lie within the structure of the engine 70 itself. FIG. 5 illustrates a compressor piston 72 slidingly reciprocating within its mating cylinder 73 and linked to the free piston Stirling engine 70 by means of a connecting rod 74. The compressor has a low pressure refrigerant gas inlet 76 which communicates through a check valve 78 to the pumping space 80. High pressure gas passes through a check valve 82 and out of the compressor through the outlet port 84 to the remaining high pressure portion of the refrigeration apparatus.

The gas spring of the present invention has a central gas spring piston 86, sealingly slidable within its cylinder 88. It is provided with a conventional piston centering port 90 and passageways 92 and 94, not forming a part of the present invention. The high pressure portion of the refrigeration apparatus is connected through a passageway 94 to an outlet port 96, formed in the wall of the cylinder 88. In this embodiment a single outlet port is used and is exposed when the piston amplitude of reciprocation exceeds one-half the axial length of the gas spring piston 86. Outlet passageways 100 and 102 are connected through passageway 104 to the low pressure portion of the refrigeration apparatus.

While certain preferred embodiments of the present invention have been disclosed in detail, it is to be understood that various modifications may be adopted without departing from the spirit of the invention or scope of the following claims.

We claim:

1. In heat pump of the type having a free piston Stirling engine connected by a drive linkage to a compressor for compressing gas from a low pressure portion of an apparatus and discharging it into a high pressure portion of the apparatus, an improved power load matching apparatus comprising:

(a) a gas spring connected to the drive linkage to apply spring force parallel to the axis of drive linkage reciprocation;

(b) an inlet gas passageway means in communication between the high pressure portion of the apparatus and the gas spring for at times supplying gas into the gas spring; and (c) valve means interposed in the inlet gas passageway means and linked to the drive linkage for opening the valve to permit gas to flow into the gas spring when the drive linkage amplitude of reciprocation exceeds a selected limit.

2. An apparatus in accordance with claim 1 wherein the gas is a refrigerant and the apparatus is a refrigeration apparatus.

3. An apparatus in accordance with claim 2 wherein a refrigerant return flow gas passageway means is connected between the gas spring and the low pressure portion of the refrigeration apparatus for returning refrigerant to the refrigeration apparatus.

4. An apparatus in accordance with claim 3 wherein a restricted orifice is interposed in the return flow gas passageway for limiting the return gas flow rate.

5. An apparatus in accordance with claim 2 or 3 or 4 wherein the gas spring comprises a piston sealingly slidable within a cylinder and wherein the valve means comprises a spool valve having the gas spring piston as the spool and having the inlet gas passageway means in communication with a port in the cylinder wall which is offset from the center of reciprocation of the piston at a position for being blocked by the piston when the reciprocation amplitude is less than said selected limit and being exposed to permit refrigerant to enter the gas spring when reciprocation amplitude exceeds the selected limit.

6. An apparatus in accordance with claim 5 wherein a check valve is interposed in at least one of the gas passageways at a polarity to permit only gas flow in a direction from the high pressure portion to the low pressure portion.

7. An apparatus in accordance with claim 5 wherein the gas spring is a double acting gas spring with the piston interposed between its two spring spaces and wherein there are two ports, one offset on each side of the center of reciprocation, each connected to the inlet gas passageway means and each positioned as recited in claim 4.

8. An apparatus in accordance with claim 7 wherein a check valve is interposed in at least one of the gas passageways at a polarity to permit only gas flow in a direction from the high pressure portion to the low pressure portion.

* * * * *